US007131899B2

(12) United States Patent
Gansel et al.

(10) Patent No.: US 7,131,899 B2
(45) Date of Patent: Nov. 7, 2006

(54) MANUAL SANDING MACHINE TOOL

(75) Inventors: Eduard Gansel, Dettenhausen (DE); Monika Renner, Weil der Stadt (DE)

(73) Assignee: Robert Bosch GmbH, Stuttgart (DE)

( * ) Notice: Subject to any disclaimer, the term of this patent is extended or adjusted under 35 U.S.C. 154(b) by 65 days.

(21) Appl. No.: 10/501,161

(22) PCT Filed: Feb. 10, 2003

(86) PCT No.: PCT/DE03/00379

§ 371 (c)(1),
(2), (4) Date: Jul. 12, 2004

(87) PCT Pub. No.: WO2004/016390

PCT Pub. Date: Feb. 26, 2004

(65) Prior Publication Data

US 2005/0085172 A1 Apr. 21, 2005

(30) Foreign Application Priority Data

Jul. 16, 2002 (DE) ..... 102 32 055

(51) Int. Cl.
*B24D 17/00* (2006.01)

(52) U.S. Cl. ..... 451/514; 451/518; 451/520

(58) Field of Classification Search ..... 451/514, 451/518, 520

See application file for complete search history.

(56) References Cited

U.S. PATENT DOCUMENTS 2,553,254 A * 5/1951 Hays ..... 451/520
2,670,579 A * 3/1954 Applegate ..... 451/515
2,729,925 A * 1/1956 Applegate ..... 451/515
2,914,889 A * 12/1959 Mosbacher ..... 451/516
3,349,523 A * 10/1967 Hutchins ..... 451/518
3,404,493 A * 10/1968 Thomas ..... 451/518
3,540,161 A 11/1970 Anton et al.
3,822,518 A * 7/1974 Sjostrand ..... 451/516
4,030,254 A * 6/1977 Marcantonio ..... 451/516
4,077,165 A * 3/1978 Hutchins ..... 451/518
4,475,317 A * 10/1984 Dicke ..... 451/356
6,626,746 B1 * 9/2003 Mayr et al. ..... 451/356
6,855,041 B1 * 2/2005 Bocka et al. ..... 451/357
6,887,143 B1 * 5/2005 Bocka et al. ..... 451/359

FOREIGN PATENT DOCUMENTS

GB 2 322 582 A 9/1998
WO 03 015985 A 2/2003
WO 03 015987 A 2/2003

* cited by examiner

*Primary Examiner*—M. Rachuba
(74) *Attorney, Agent, or Firm*—Michael J. Striker

(57) ABSTRACT

A manual grinding tool, in particular an oscillating sander (10), with a housing (12) and an abrasive sheet carrier (14), against the working surface (15) of which an installable abrasive sheet (16; 150) rests, whereby said abrasive sheet is installed using clamping means (20, 23; 360, 500) which clamp opposite abrasive sheet ends (17, 19; 155) to the abrasive sheet carrier (14), is made easier to operate and handle because it is lighterweight and more effective by the fact that the clamping means (20, 23; 350, 500), together with an abrasive sheet end (17; 155) clamped thereto, are capable of being moved away from the diametrically opposed abrasive sheet end (19; 155) which is also clamped thereto, so that said abrasive sheet is locked under tensile stress, whereby the clamping means are composed of resilient material.

13 Claims, 8 Drawing Sheets

MANUAL SANDING MACHINE TOOL

BACKGROUND OF THE INVENTION

The present invention concerns a manual grinding tool.

An orbital sander with a sanding plate on which abrasive sheets are installed is made known in GB patent publication 23 22 582; the abrasive sheets are capable of resting with their back against the underside of the sanding plate and are clampable in place on their top side. The underside of the abrasive sheets, where sanding means are provided, faces downward/outwardly and, when the abrasive sheet carrier is mounted on a workpiece, it is usable for sanding.

The operator must use both hands to clamp the abrasive sheets in place, and the hand power tool should be placed on a solid surface. Using one hand, one end of the abrasive sheet is inserted into a slit between an opened clamping jaw and the top side of the abrasive sheet carrier, and the clamping jaw is held open in the release position until the end of the abrasive sheet is inserted so that it closes via spring force when the clamping jaw is released. This is the clamped position in which the abrasive sheet end is fixed. The abrasive sheet is automatically tightened to a certain extent in that the rotatably mounted clamping jaw tries to roll away from the abrasive sheet end, thereby carrying it along, due to an inclined-plane contact surface on the top side of the abrasive sheet carrier.

The same procedure is used with the other abrasive sheet end as is used with the first abrasive sheet end, whereby the clamping force and tightening force of the clamping means are limited.

The same disadvantages also apply for the abrasive sheet clamping system according to U.S. Pat. No. 3,540,161.

SUMMARY OF THE INVENTION

The manual grinding tool according to the present invention has the advantage of particularly convenient, rapid clamping—combined with the abrasive sheet being stretched tight—using only one hand, with simplified manufacture of the clamping means at lower cost and significant weight reduction. This results in increased abrasive performance and greater overall efficiency of the manual grinding tool.

Due to the fact that the first abrasive sheet end is capable of being inserted using just one hand into a self-opening slit and is automatically clampable there, and, subsequently, the second abrasive sheet end is insertable—also using just one hand—into the clamping device and is then capable of being stretched tight, to the tearing limit, the abrasive sheet is capable of being fixed quickly and safely against misuse between the two clamping points and the working surface of the abrasive sheet carrier in such a manner that it is stretched tightly and, during sanding, a relative motion between the abrasive sheet carrier and the abrasive sheet is largely prevented.

Due to the fact that the slit which clamps the first abrasive sheet end is opened using a single, central, easily located operating button to release the abrasive sheet, the operating comfort of the manual grinding tool is particularly high.

Due to the fact that one of the clamping means is configured as tongs, between the clamping jaws of which an abrasive sheet end is clampable, and due to the fact that the tongs—together with the clamped abrasive sheet end—are movable around a swivel axis and are lockable in an end position, secure clamping followed by stretching-tight of the abrasive sheet is attainable in a convenient and reliable manner using simple means.

The tongs have the advantage that abrasive sheets of any thickness are clampable with maximum clamping force, because a long closing path enables all dimensional differences to be compensated for in a sensitive manner, whereby the clamping force attained is stronger than has been previously achieved. In addition, abrasive sheets having different lengths—within limits—can be installed on the hand power tool, because a long overhang can easily form between the open active clamping jaw—configured in the shape of a half ring or bracket—and the passive clamping jaw, and it can be comfortably accommodated there.

Due to the fact that the passive clamping jaw is configured as corrugated spring sheet which is capable of being deformed around a bending region in the manner of a hinge, the one end of which is clamped to the housing in the manner of a transverse beam, and the free end of which has a friction lining, in particular rubber, the desired flat spring characteristic (a small force/travel ratio) with extremely short installation length of the passive clamping jaw is attainable in a space-saving fashion.

Due to the fact that the passive clamping jaw—as viewed from the free end, from right to left—first extends upwardly as a sine wave followed by a semi-sine wave having a smaller amplitude, the corrugated spring sheet is reliably clampable with the desired spring force.

Due to the fact that the active clamping jaw is part of a two-armed clamping lever, one of which said clamping levers serves as a handle which is detachably lockable in the clamped position in an over-latching manner, and due to the fact that the tongs, to this end, are pivotable around the swivel axis between two end positions that define the clamped and released positions, it is particularly easy to install an abrasive sheet.

Due to the fact that the clamping lever can be pivoted into its holding position in an over-latching manner via an over-latching hook bent inwardly toward the housing in the manner of a barb, the tongs are lockable in a particularly comfortable and operationally-reliable manner by pressing the clamping lever perpendicularly and/or they are capable of being released in a failsafe manner by pressing them toward the housing in a self-locating manner.

Due to the fact that, with the tongs in the clamped position, the active clamping jaw rests against the passive clamping jaw with a minimum clamping force achievable with spring means, the clamping force at the abrasive sheet end to be clamped is capable of being determined by selecting the appropriate elastic means.

Due to the fact that the active clamping jaw is bent in the manner of a half ring and grips around the passive clamping jaw in such a manner that it rests against the outside of the passive clamping jaw to clamp the abrasive sheet and carries it along when pivoted into the clamped position, a user-friendly clamping-tightening mechanism with reduced risk of injury when replacing the abrasive sheet and/or working with the manual grinding tool is created, because protruding edges on the manual grinding tool are prevented. A defined spring load-deflection curve of the active clamping jaw is achieved via its bracket or arch-shaped configuration having a certain wire diameter, so that a maximum clamping force between the clamping jaws is established in the clamped position.

Due to the fact that the passive clamping jaw has a full-length longitudinal notch to accept the active clamping jaw, the grip between the passive clamping jaw and sandpaper end is improved and the clamping force is strengthened further.

Due to the fact that, in addition to the tongs for the one abrasive sheet end, clamping means for the other abrasive sheet end are provided, which said clamping means act in a manner such that they allow the abrasive sheet to enter in a preferred direction, but release in the reverse direction with special actuation, it is possible to clamp the abrasive sheet quickly using just one hand.

In this case, one-hand operation means that, in fact, only one hand need be active to insert and fix the abrasive sheet. The other hand can be used alone to fix the hand power tool, e.g., to press it against a base.

Due to the fact that the clamping jaws are composed of elastic, rubber-like material, the clamping servo effect becomes stronger as the clamping of the abrasive sheet increases. This servo effect is also strengthened by the fact that the outer contour of the clamping jaw is bent progressively with a small variation in pitch.

Due to the fact that the clamping jaws are composed of sheet metal and/or wire and are provided with a rubber coating, they are easy-to-manufacture, lightweight and functionally reliable.

Due to the fact that the clamping jaw and/or the active clamping jaw are insertable in a groove in the housing and are secured against coming out by means of a screw which extends partially over the groove, a high degree of functional safety of the tongs is achieved with little effort when the sandpaper is clamped.

Due to the fact that the clamping jaw is positioned horizontally and the insertion slit must be opened wide—whereby it can even lie below the plane of the sanding plate—the abrasive sheet need not be angled upward or bent to be inserted into the slit; instead, it can be inserted in a self-locating, extremely convenient—"blindly", even—very casual manner, and then stretched tight.

Due to the fact that the clamping lever is approximately 60 mm long and the active jaw has a lever length of approximately 20 mm, a convenient, secure clamping of the abrasive sheet is possible.

BRIEF DESCRIPTION OF THE DRAWINGS

Exemplary embodiments of the invention are described in greater detail in the subsequent description with reference to an associated drawing.

DETAILED DESCRIPTION OF THE PREFERRED EMBODIMENTS

Figure 1:
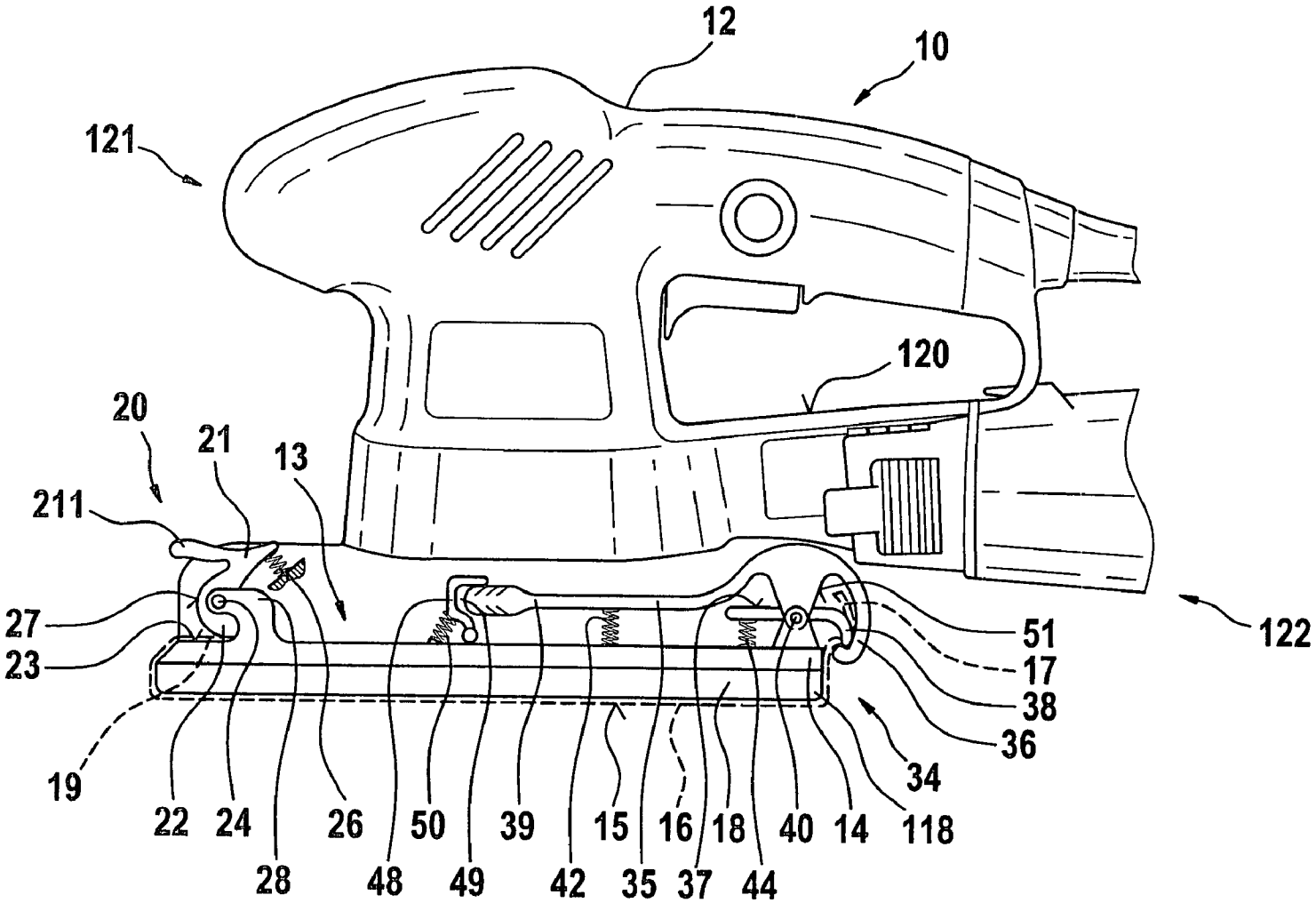
FIG. 1 shows a side view of the manual grinding tool according to the invention with clamping device.

FIG. 1 shows a manual grinding tool 10 (orbital sander) with a housing 12 that has a handle on the outside and an electric motor on the inside (not shown). An abrasive sheet carrier 14 is located at the bottom of housing 12, which said abrasive sheet carrier, driven by a motor, is capable of being set into oscillating motion relative to housing 12 and, as a result, can remove material from a work piece (not shown) via sanding with an abrasive sheet 16 secured tightly below on its working surface 15. The grinding dust that is created is capable of being blown out and/or suctioned up from the front side 121 toward the rear side 122 of manual grinding tool 10 via suction connecting piece 120. Abrasive sheet 16 rests with its back side against the underside of abrasive sheet carrier 14.

A clamping means designed as a two-armed clamping lever 20 with a swivel axis 24 is positioned in the front on the top side 13 of abrasive sheet carrier 14. Above swivel axis 24, clamping lever 20 is a swing arm and, below said swivel axis, it is a clamping jaw 22. It rests with its outer contour 27 bent in the shape of a saber against locking face 23 of top side 13 of abrasive sheet carrier 14. Swivel axis 24 of clamping lever 20 is located on a bracket 28 on the top side of abrasive sheet carrier 14.

A tension spring 26 bears between the top side of swing arm 21 and an abutment (not shown) in housing 12, which said tension spring can also be configured as a leg spring; it tries to pivot clamping lever 20 in the clockwise direction, whereby it presses clamping jaw 22 against locking face 23 and thereby clamps abrasive sheet end 19 in place.

In the upper region, swing arm 21 has a single, projecting knee serving as push button 211. By means of this, swing arm 21 is capable of being moved downward using a finger, whereby tension spring 26 is loaded. Clamping jaw 22 then lifts away from locking face 23, and the gap between outer contour 27 and locking face 23 opens so wide that abrasive sheet end 19 is released and can be removed.

The distance between swivel axis 24 of clamping lever 20 and locking face 23 is smaller than the distance between swivel axis 24 and the radially outermost point of outer contour 27, so that, in the position with spring preload via spring 26, clamping jaw 22 bears against locking face 23 on the top side 13 of abrasive sheet carrier 14. As a result, the clamping force on abrasive sheet 16 increases in proportion to the forces that try to release abrasive sheet 16 against the direction of insertion.

Tension spring 26 is preloaded to such a low extent that, when outer contour 27 of clamping jaw 22 is tapped even slightly, abrasive sheet 16 displaces said clamping jaw from the outside against the direction of tension, creates the gap by itself which is needed for insertion, and is easily inserted and pushed back with one hand.

Clamping jaw 22 is composed at least partially of elastic, rubber-like material with a high coefficient of friction that limits relative motion between abrasive sheet 16 and clamping jaw 22.

As viewed on the right, a clamping-tightening device configured as tongs 34 is located on the rear side 122 of abrasive sheet carrier 14. It is composed of a clamping lever 35 with curved active clamping jaw 36 and a handle 39 that is a two-armed lever which is pivotable around a swivel axis 40. Active clamping jaw 36 is composed of elastic material, e.g., spring steel. Also capable of being pivoted around swivel axis 40 is a clamping lever 37 that forms passive clamping jaw 38 and bears against the inner contour of active clamping jaw 36 when abrasive sheet 16 is tightened. The other abrasive sheet end 17, which is diametrically opposed to abrasive sheet end 19, is inserted and retained between passive clamping jaw 38 and active clamping jaw 36.

When tongs 34 with retained sandpaper end 17 are pivoted around swivel axis 40 in the counterclockwise direction, its distance from the other sandpaper end 19 increases. As a result, abrasive sheet 16 is tightened and pulled taut against the underside of abrasive sheet carrier 14. The tightening of abrasive sheet 16 is apparent in rear lower edge 118 of cushion that is pressed round in shape.

When tongs 34 are in the clamped position, clamping lever 35 assumes an end position in which handle 39 is snapped into locking groove 49 in the rear and/or lateral latching hook. By pressing latching hook 48 backward with the thumb and/or by pivoting handle 39 out of locking groove 49 against spring 50, clamping lever 35 is released; it can pivot back into its open position with spring preload via spring 42. Following said clamping lever, passive clamping jaw 38—acted upon by a further compression spring 44—moves into its own end position. Clamping lever 35, under spring preload, continues to pivot past this point until its contact surface 51 bears against the top side 47 of passive clamping jaw 38. In this stop position, tongs 34 are wide open, and the distance between active clamping jaw 36 and passive clamping jaw 38 is so great that sandpaper end 17—indicated with the dashed line—can be inserted into tongs 34 quasi blindly.

Compression spring 44, which applies preload to passive clamping jaws 38, determines and/or limits the clamping force between active clamping jaw 36 and passive clamping jaw 38.

If clamping lever 35 is released from its clamped position by releasing latching hook 48 and is pivoted around axis 40 in the clockwise direction to replace the abrasive sheet, the distance between the clamping points of sandpaper ends 17, 19 becomes shorter once more, thereby releasing tension from abrasive sheet 16, allowing it to be easily removed.

Figure 2:
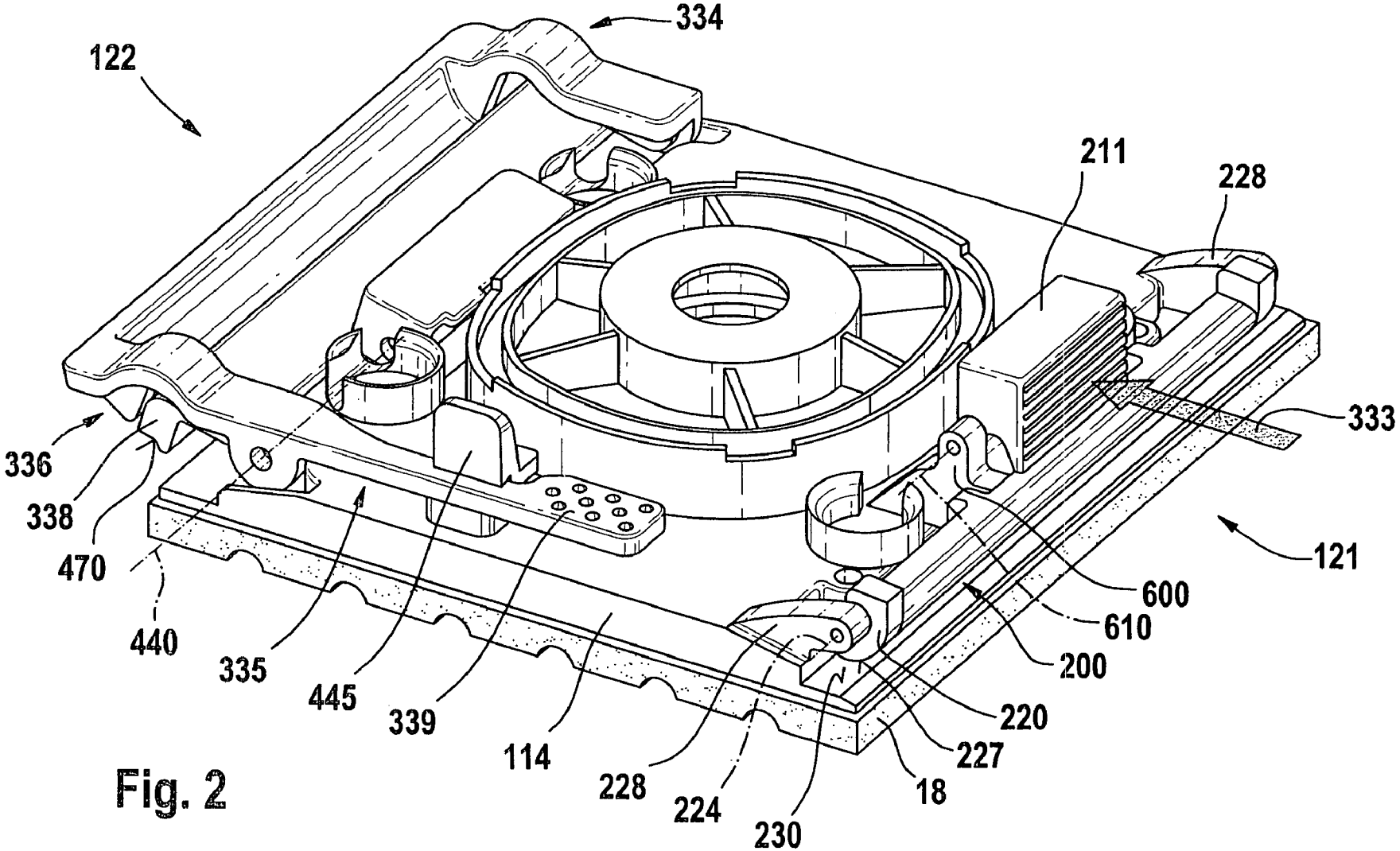
FIG. 2 is a top view at an angle from above of the abrasive sheet carrier of a further embodiment of the manual grinding tool with clamping device.

FIG. 2 shows a spacial depiction of a further exemplary embodiment of abrasive sheet carrier 114 and manual grinding tool 10 according to FIG. 1 as a top view diagonally from the front. A clamping lever 200 is located on front side 121, as viewed on the right, which said clamping lever essentially corresponds to that in FIG. 1, although it has a separate actuating button 2110 that is supported in an abutment 600 in a manner that allows it to pivot around an axis of rotation 610 and bears elastically against the housing (not shown) via a compression spring (not shown).

When button 2110 is actuated in the direction of arrow 333, the part of button 2110 located above axis 610 moves toward the housing. The part located below axis 610 pivots outwardly, whereby it bears against the top part of clamping lever 200. When button 2110 is actuated, said clamping lever is pivoted outwardly in the clockwise direction, so that clamping jaw 220 lifts away from locking surface 230 and an abrasive sheet end clamped therebetween can be removed, because clamping force is no longer applied.

To enhance understanding of FIG. 2, reference is made to the parts in FIG. 1 having the same function and configuration. The first numeral in the reference numbers in FIG. 1 is duplicated and placed in front of the reference numbers of the equally-acting parts in FIG. 2 to distinguish them from yet match them to the reference numbers in FIG. 1.

As viewed on the left, abrasive sheet carrier 114 has tongs 334 on its rear side 122, which said tongs essentially correspond to the tongs 34 explained in reference to FIG. 1, but the details of which have a different configuration. A clamping lever 335 for pivoting tongs 334 is located on only one side of abrasive sheet carrier 114, and it is supported on this side at a stop 445 in a springy, latching manner.

Tongs 334 are shown in the clamped state, in which their clamping pont and/or an abrasive sheet end (not shown) has been pivoted to the greatest possible distance away from clamping lever 200 on the diametrically opposed side of abrasive sheet carrier 114.

Figure 3:
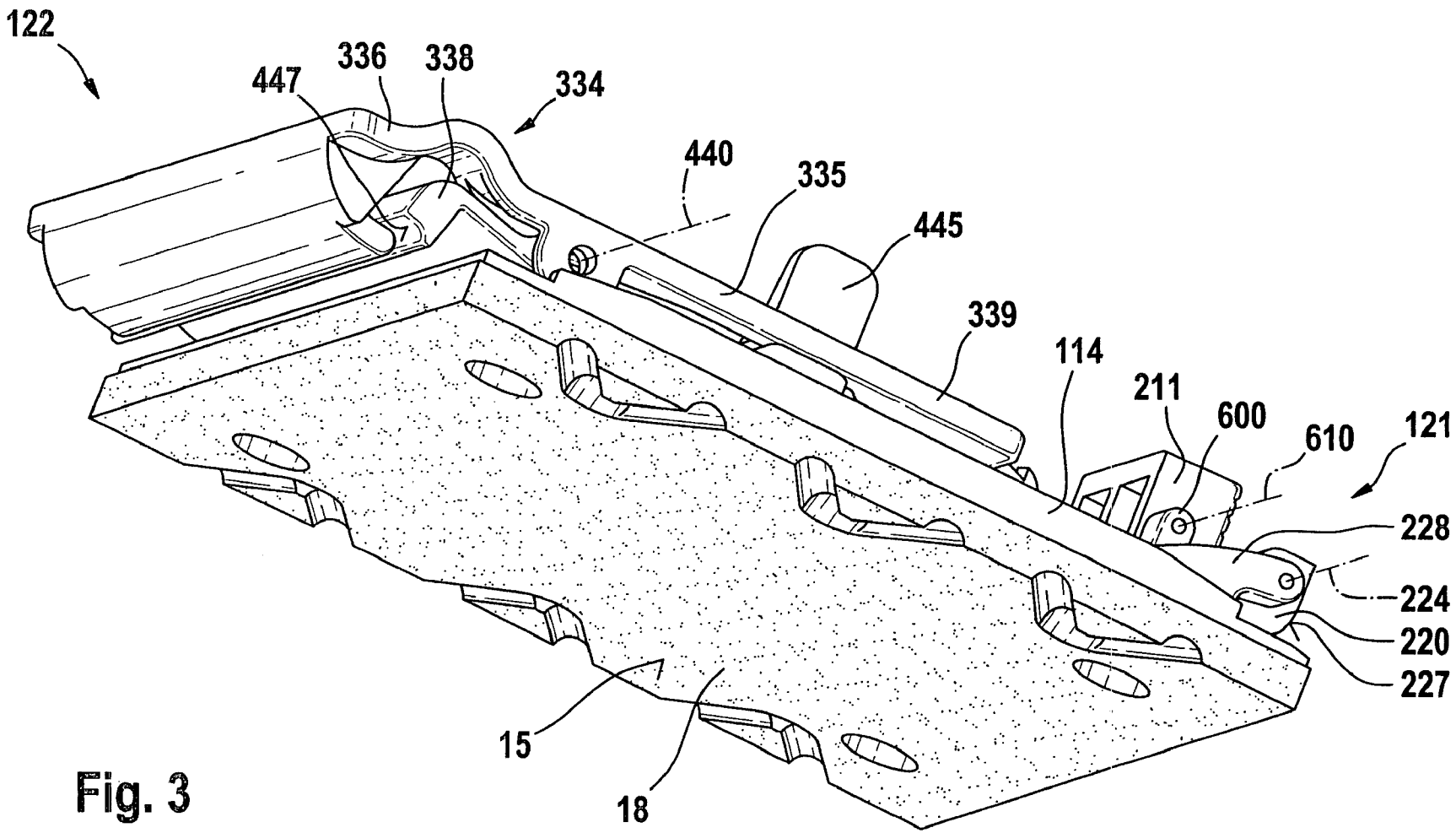
FIG. 3 is the underside view according to FIG. 2.

FIG. 3 shows the details of abrasive sheet carrier 114 according to FIG. 2 at an angle from the rear underside, whereby the configuration of active clamping jaw 336 in interaction with passive clamping jaw 338 is clearly shown. In the clamped position shown, they bear against each other and can retain an abrasive sheet end (not shown) clamped between them pivoted away from clamping lever 200, so that an associated abrasive sheet is capable of being stretched tightly such that movement of the abrasive sheet relative to the working surface of abrasive sheet carrier 114 is minimized. The parts of clamping lever 200 explained hereinabove with regard for FIGS. 1 and 2 are clearly visible and will not be explained again here.

The procedure for installing an abrasive sheet 16 in manual grinding tool 10 according to FIG. 1 will be explained hereinbelow: Manual grinding tool 10 with opened tongs 334 is held with one hand. Using the other hand, first abrasive sheet end 19 is inserted at clamping lever 20 on the front side of manual grinding tool 10 by pressing against outer contour 27 of clamping lever 22. A gap opens between clamping jaw 22 and locking surface 23, into which said gap abrasive sheet enters without clamping lever 20 having to be actuated separately. Even a small inserted section of the abrasive sheet end is "automatically" prevented, via strong force, from coming back out, i.e., it is clamped, and clamping lever 20 must be pivoted in the release direction to pull it back out.

When abrasive sheet 16 is slid slightly forward, abrasive sheet end 19 is inserted between clamping jaw 22 and locking face 23 so far that it extends past it by approximately 5 mm. As a result, a relatively small amount of effort is required to clamp first abrasive sheet end 19 tightly and securely to its abrasive sheet carrier 14 on the front side of manual grinding tool 10.

Subsequently, second abrasive sheet end 17 is inserted and locked in opened tongs 34 located on the rear side of abrasive sheet carrier 14. Abrasive sheet 16 is thereby stretched tightly. Since the clamping point of tongs 1334 moves along a circuit around swivel axis 410 away from the front side of manual grinding tool 10, abrasive sheet 16 is held tightly against abrasive sheet carrier 140 and can therefore be used with high efficiency for sanding.

To remove abrasive sheet 16 from manual grinding tool 10, clamping lever 20 is moved by pressing button 211—as horizontal extension of swing arm 21—together with said button around swivel axis 24. Clamping jaw 22, with its outer contour 27, lifts away from abrasive sheet 16 and locking face 23 in such a manner that abrasive sheet 16 can easily be pulled out of the widening gap.

Figure 4:
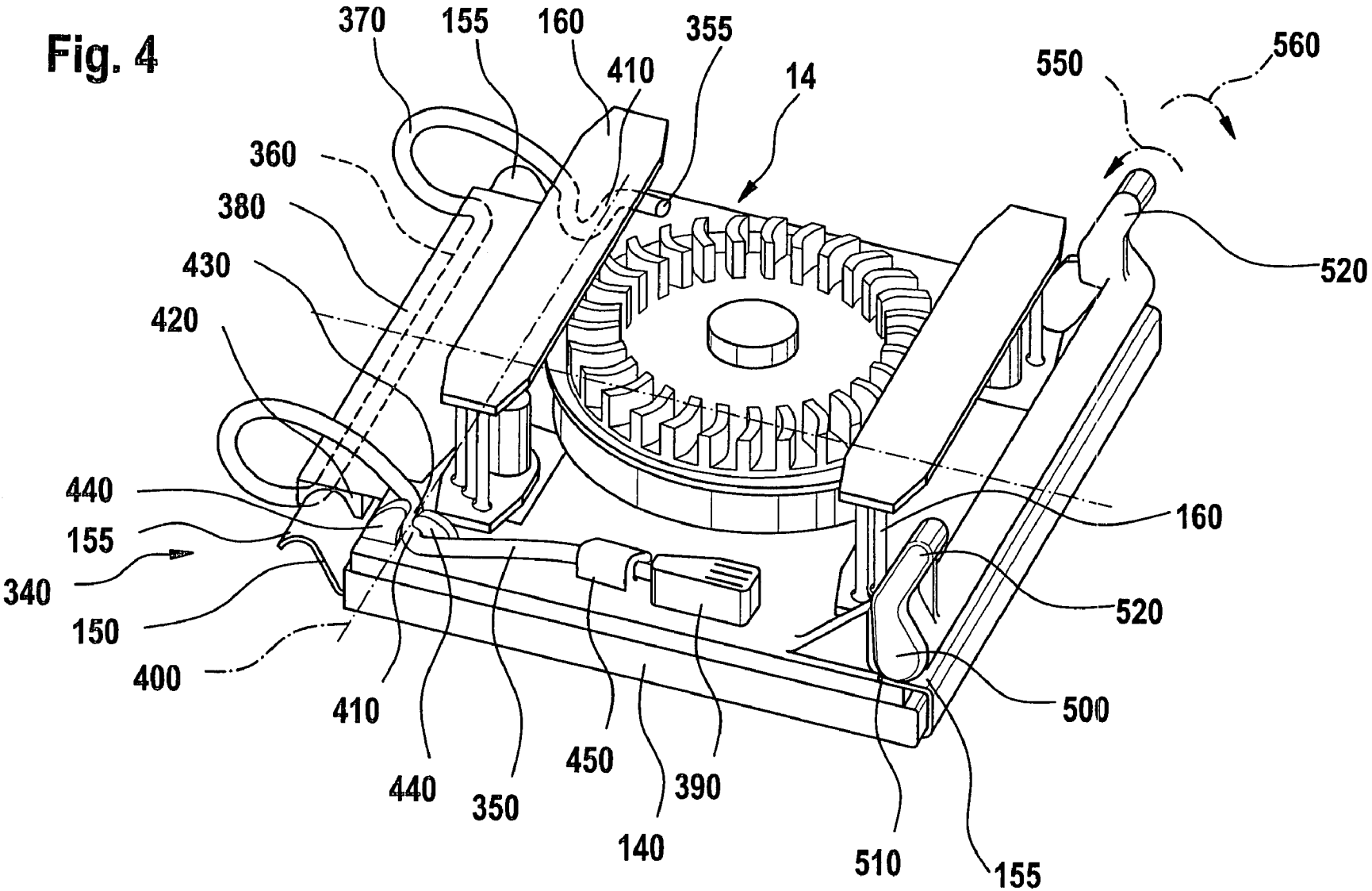
FIG. 4 is a further exemplary embodiment of the manual grinding tool according to the invention.

FIG. 4 shows a top view of abrasive sheet carrier 14 of a manual grinding tool 100 with a further embodiment of abrasive sheet-clamping device 340, 500 according to the invention.

The front side of abrasive sheet carrier 14 is seen on the right, whereby a pivoting lever 500 is shown on its top side, which said pivoting lever, with its clamping jaw 510, presses an abrasive sheet end 155 of an abrasive sheet 150 downward toward the top side of abrasive sheet carrier 14 and retains it there. Pivoting lever 500 is capable of being pivoted against the spring force of a leg spring (not shown) in the release direction, as indicated by directional arrow 560; when the end position is reached, abrasive strip end 155 can be pulled out under clamping jaw 510. If pivoting lever 500 is pivoted via its handle 520—as shown on the left—in the direction of arrow 550, abrasive sheet end 155 is clamped tightly. Since pivoting lever 500 follows sandpaper end 155, when said sandpaper is pulled outwardly, the abrasive sheet is clamped increasingly more tightly.

Abrasive sheet end 155—shown on the left—is clamped tightly at the rear side of manual grinding tool 1000 between a clamping jaw 340 that is composed of an active jaw 360 and a passive jaw 380. Active clamping jaw 360 is formed by a wire bracket 370. Said wire bracket 370 is bent nearly in the shape of a semicircle—starting at swivel axis 400 and extending toward the left, as seen in the drawing—whereby it forms the crossbar-shaped active clamping jaw 360 from a radially inwardly bent region, bent at a right angle outwardly and/or axially. Said active clamping jaw extends parallel to the rear transverse edge of abrasive sheet carrier 14 at a distance from it and transitions—on the other side, with mirror symmetry to the bent region of wire bracket 370—into an identically semicircularly bent second region that bears with its rear region on the top side of abrasive sheet carrier 14.

Spring bracket 370 transitions from its region bent in the shape of a "c" at its two symmetrical contact surfaces on the top side of abrasive sheet carrier 14, both of which said spring brackets are bent nearly perpendicularly outwardly parallel to the top surface of abrasive sheet carrier 14 into one axle stub 410 each, each axle stub forming—together with one groove 430 each between two projections 440 designed in the manner of abutments—a rocker pivot around swivel axis 400.

Adjacent to axle stub 410, each wire bracket 370 transitions outwardly into a 90° bend. On the front side—as shown in the drawing—it extends parallel to longitudinal axis 370 of handheld oscillating sander 10 and forms a clamping lever 350 with a handle 390. On the rear side—as shown in the figure—it forms a damping piece 355. With clamping tongs 340 in the clamped position, said damping piece bears against the top side of abrasive sheet carrier 14 such that relative motion does not occur between wire bracket 370 and abrasive sheet carrier 14 when oscillating sander 10 is operated. As a result, vibrations and disturbing noises are prevented when oscillating sander 10 is operated.

In the clamped position, clamping lever 350 is capable of being hung in latching hook 450 in an over-latching manner. The crossbar-shaped region of active clamping jaw 360 thereby bears against an elastic contact surface 420—which has particularly good grip—of passive clamping jaw 380, said contact surface being composed of plastic.

Contact surface 420 of passive clamping jaw 380 is formed by a rubbery strip part that is secured on the outer end of passive clamping jaw 380 configured as surface spring. Passive clamping jaw 360 extends parallel to the surface of abrasive sheet carrier 14 and is fixed thereto by the fact that it is clamped tightly under the foot-like end of oscillation body 160.

Since passive clamping jaw 380 is configured as surface spring, it does not need any special means, e.g., a joint, to define swivel axis 400.

As shown on the right, i.e., on the front side, abrasive sheet carrier 14 carries an abrasive sheet clamping system that corresponds in principle to that according to FIG. 1. The only difference is that pivoting lever 500 is preloaded in its clamping position by a leg spring (not shown) instead of by a tension spring.

Figure 5:
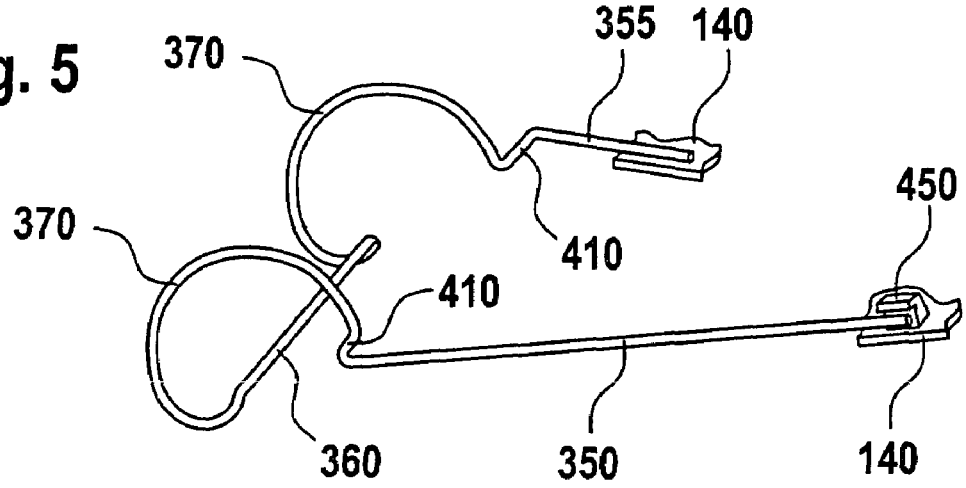
FIG. 5 is a spacial representation of the active clamping jaw made of wire, shown alone.

FIG. 5 shows a schematic depiction of active clamping jaw 360 as an element bent out of a single wire part. It is easy to see how clamping lever 350, after the first right-angled bend, transitions into first axle stub 410, and, from there via the second right-angled bend, it transitions into first semicircular wire bracket 370, from there, via the third right-angled bend, it transitions into the actual, crossbar-shaped active clamping jaw 360, from there, via the fourth right-angled bend, it transitions into the second, semicircular wire bracket 370, from there, via the fifth right-angled bend, it transitions into the second axle stub 410, and from there, via the final right-angled bend, it transitions into extension 355 serving as oscillating damper, which clamps against top side 140 of abrasive sheet carrier 14 with preload.

Figure 6:
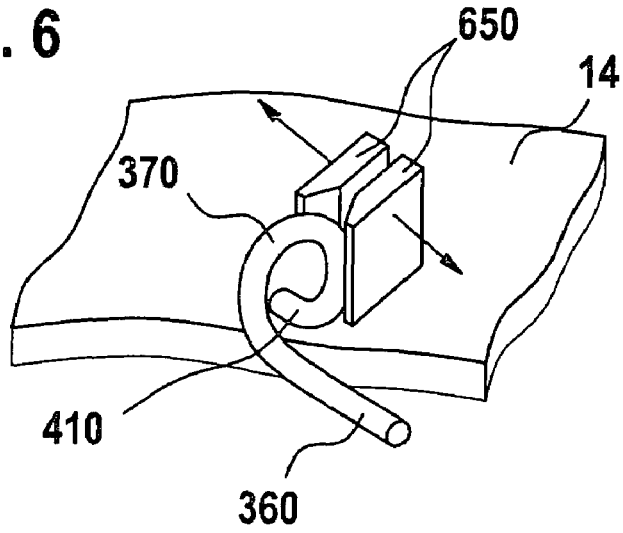
FIG. 6 is an active clamping jaw end, shown alone.

FIG. 6 shows a further variant for oscillation damping of second wire bracket 370 that is elastically clampable in the clamped position between two elastic damping jaws 655, so that vibrations and noises are therefore suppressed. Damping jaws 650 are located on the top side of abrasive sheet carrier 14.

Figure 7:
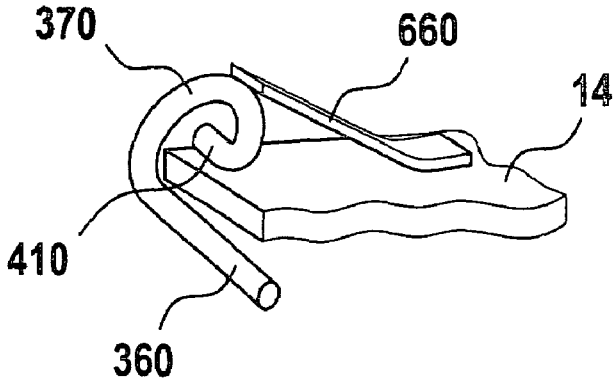
FIG. 7 is an exemplary embodiment of the active clamping jaw end.

FIG. 7 shows a further variant for vibration damping of second wire bracket 370 via a leaf spring 660 which bears outwardly on its arched circumference. Via its preload, wire bracket 370 and/or axle stub 410 are held against abrasive sheet carrier 410 and vibrations are suppressed.

Figure 8:
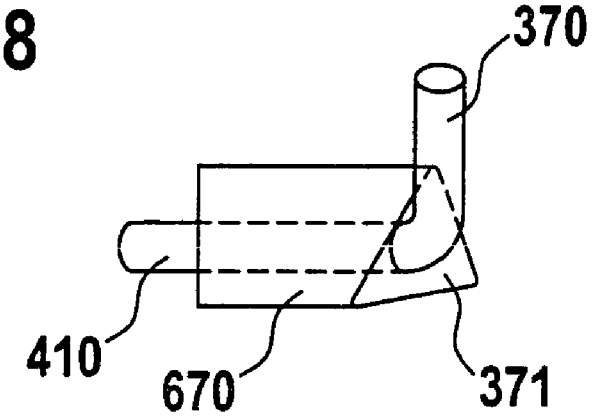
FIG. 8 is another exemplary embodiment of the active clamping jaw end.

FIG. 8 shows a fourth variant for oscillation damping of second wire bracket 370 using a damping rubber member 670 positioned around the outer axle stub 410, against the diagonally positioned angular surface 671 of which wire bracket 370 bears in the clamped position, and the oscillations of which are suppressed.

Figure 9:
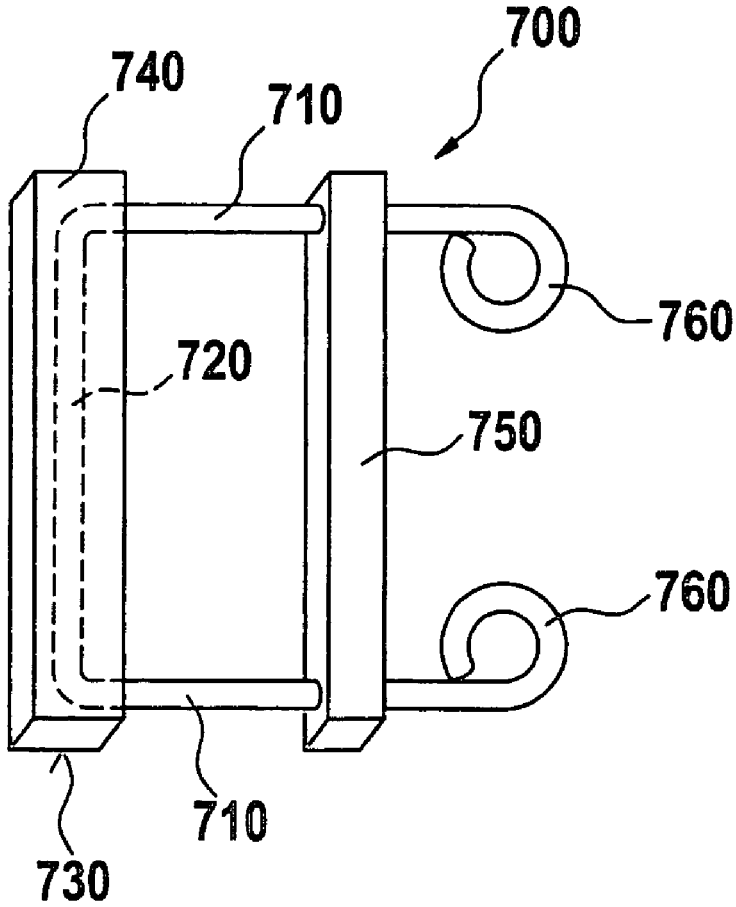
FIG. 9 is an exemplary embodiment of a passive clamping jaw made of wire.
Figure 10:
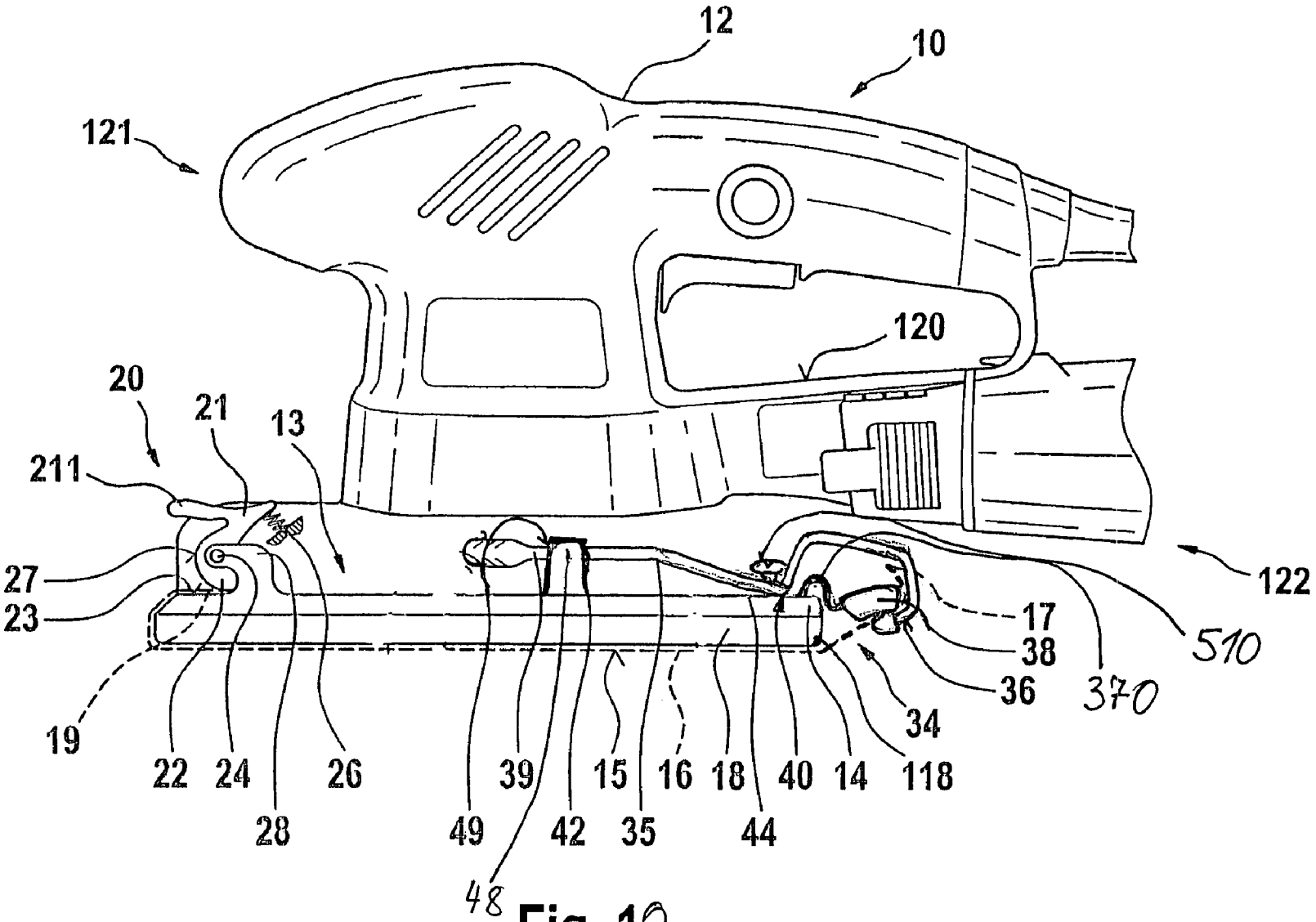
FIG. 10 is a further exemplary embodiment of a clamping jaw made of spring wire and spring sheet.

FIG. 9 shows a further exemplary embodiment of a passive clamping jaw 700 alone, which is not composed of a surface spring 380 as in FIG. 4, but rather of a U-shaped spring wire piece. Between its U-legs 710, passive clamping jaw 700 has a connecting piece 720 on its curvature with a contact body 740 made of rubber or plastic that forms a contact surface 730 for abrasive sheet end to rest against and for active clamping jaw 360 to engage with (FIG. 4). To dampen oscillations, passive clamping jaw 700 has a crossbar-shaped connecting body 750 composed of plastic or rubber, the connecting body being penetrated by U-legs 710.

Ends 760 of U-legs 710 bent inwardly in the shape of a circle form screw eyelets that are gripped over by screws or the foot-shaped lower parts of oscillation body 160 and are thereby securable to abrasive sheet carrier 14.

Figure 11:
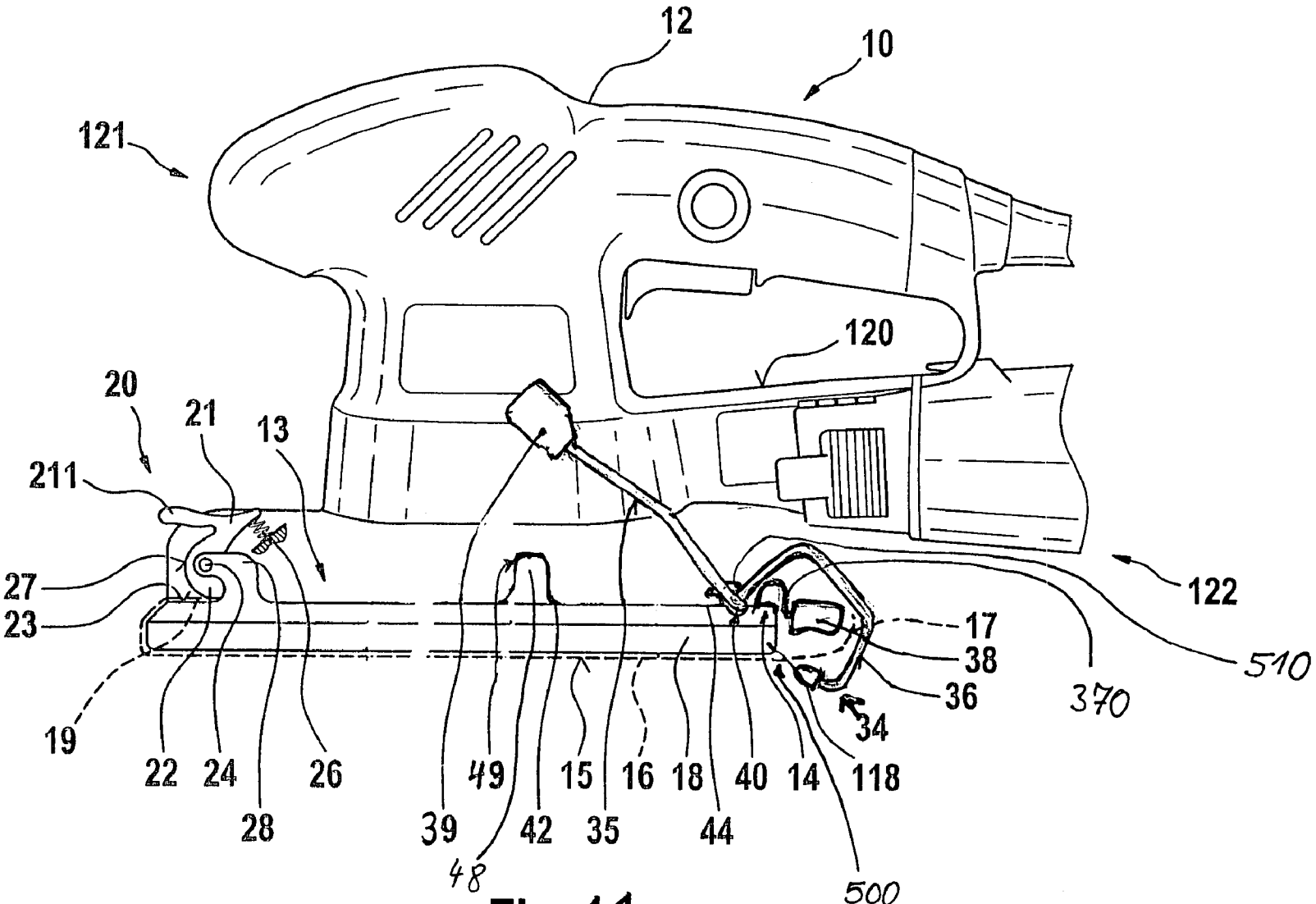
FIG. 11 is the exemplary embodiment according to FIG. 11 with opened clamping jaw.

FIG. 11 is nearly identical to FIG. 1 and shows a manual grinding tool 10 (oscillating sander) with a housing 12 that includes a handle on the outside and an electric motor on the inside (not shown). An abrasive sheet carrier 14 is located at the bottom of housing 12, which, driven by a motor, is capable of being set into oscillating motion relative to housing 12 and, as a result, can remove material from a work piece (not shown) via sanding with an abrasive sheet 16 secured tightly underneath on its working surface 15. The grinding dust that is created is capable of being blown out and/or suctioned up from the front side 121 toward the rear side 122 of manual grinding tool 10 via suction connecting piece 120. Abrasive sheet 16 rests with its back side against the underside of abrasive sheet carrier 14.

A clamping means designed as a two-armed clamping lever 20 with a swivel axis 24 is positioned in the front on top side 13 of abrasive sheet carrier 14.

Reference is made to the description of FIG. 1 regarding the remaining details of clamping lever 20.

As viewed on the right, a clamping-tensioning device configured as tongs 34 is located on the rear side 122 of abrasive sheet carrier 14, the clamping-tensioning device deviating from that according to FIG. 1 in that it is composed of parts of wire and/or spring steel sheet having intrinsic spring action. It is composed of a clamping lever 35 with active clamping jaw 36 having mutiple bends and/or curves, the active clamping jaw conforming in principle to that according to FIG. 5, but with a slightly altered contour of the curved region. It has a handle 39 which forms a two-armed lever which is pivotable around a swivel axis 40—which is secured in simple fashion using a screw 510—formed by a groove (not shown) on top side 13 of abrasive sheet carrier 14. Active clamping jaw 36 is composed of bent spring steel wire. A clamping lever 370 made of corrugated spring sheet bearing against the inner contour of active clamping jaw 36 when abrasive sheet 16 is clamped is also pivotable around the geometric extension of pivot axis 40, the clamping lever forming passive clamping jaw 38. The other abrasive sheet end 17 that is diametrically opposed to first abrasive sheet end 19 is inserted and retained between passive clamping jaw 38 and active clamping jaw 36.

When tongs 34 with retained sandpaper end 17 are pivoted around swivel axis 40 in the counterclockwise direction, the distance between sandpaper ends 17, 19 relative to each other increases. As a result, abrasive sheet 16 is tightened and pulled tightly against the underside of abrasive sheet carrier 14. The tightening of abrasive sheet 16 becomes noticeable via the rear lower edge 118 of cushion 18 that is pressed round in shape.

When tongs 34 are in the clamped position, springy clamping lever 35 assumes an end position in which handle 39 is snapped into locking groove 49 of lateral latching hook 48. By pressing clamping lever 35 toward housing 12, said handle comes out of locking groove 49 and can thereby pivot freely back into its open position. Passive clamping jaw 38, which springs back into its own position, thereby acts on said handle and carries it along into the "opened" position. Clamping lever 35 is capable of being pivoted further by hand to an end position forming a wide opening slit 500 (FIG. 2) between active clamping jaw 36 and passive clamping jaw 38. In this end position, tongs 34 are opened wide and the distance between active clamping jaw 36 and passive clamping jaw 38 is so great that sandpaper end 17—indicated with the dashed line—can be inserted into tongs 34 quasi blindly and in a self-locating manner without it having to be bent further upward out of the plane of working surface 15.

The surface spring 370, which self-tensions passive clamping jaw 38, having the form of a one-and-a-half sine wave with a small amplitude region toward the clamping point determines and/or limits the clamping force between active clamping jaw 36 and passive clamping jaw 38 in the clamped state, whereby, when surface spring 270 is short in design, a very strong clamping force is achieved, accompanied by a good hinged joint function.

If, to replace the abrasive sheet, clamping lever 35 is released from its clamped position by unlatching it from latching hook 48 and is pivoted around axis 40 in the clockwise direction, the distance between the clamping points of sandpaper ends 17, 19 becomes shorter once more, whereby abrasive sheet 16, relieved of tension, is simultaneously capable of being easily removed from opening slit 500.

FIG. 12 shows the horizontally situated tongs 34 with manual grinding tool 10 according to FIG. 11 opened with loosely inserted sandpaper end 17. By pivoting clamping lever 35 in the counterclockwise direction, active clamping jaw 36 moves closer to passive clamping jaw 38 and thereby carries sandpaper end 17 along due to its high friction on the rubber lining—indicated by the bold line—in the direction toward passive clamping jaw 38 and clamps it tightly thereto. When active clamping jaw 36 is pivoted further, it carries passive clamping jaw with clamped sandpaper end 17 along on its pivot path, thereby tightening abrasive sheet 16 and holding it tightly in the tightened position as a result of clamping lever 35 which is latched in latching hook 48. The desired clamped position of abrasive sheet 16 is therefore created.

The means of attaining the object of the invention, according to the invention, are not limited to the arrangement of a self-clamping lever system on the side diametrically opposed to the tongs; instead, a conventional clamping lever system with spring preload can also be provided.

What is claimed is:

1. A manual grinding tool, comprising:

a housing (12), an abrasive sheet carrier (14), and clamping means (20, 23; 360, 500) for retaining opposite abrasive sheet ends (17, 19; 155) of an abrasive sheet (16; 150) which is capable of resting against abrasive sheet carrier (14), wherein the clamping means (20, 23; 340, 500), together with an abrasive sheet end (17, 155) clamped thereto, are capable of being moved away from the other abrasive sheet end (19, 155) which is also clamped, so that the abrasive sheet (16; 150) is lockable under tensile stress, whereby the clamping means (20, 23; 340, 500) are composed of resilient material, wherein one of the clamping means (20, 23; 340, 500) is configured as tongs (34; 340) and has clamping jaws (36, 38; 360, 380), between which an abrasive sheet end (17, 19; 155) is clampable, wherein the tongs (34; 340), with the clamping jaws (36, 38; 360, 380) and the clamped abrasive sheet end (17, 19; 155), are movable around a swivel axis (40; 400) and are detachably lockable in a pivoted-out position, wherein the active clamping jaw (360) is a single-component, bent wire element that is positioned diametrically opposed with a crossbar to a corresponding surface of the passive clamping jaw (380) in a manner that allows it to be pressed together in the manner of tong jaws, and wherein the passive clamping jaw (380) is a resilient part that is rigidly located with one end on the top side of the abrasive sheet carrier (14).

2. The manual grinding tool as recited in claim 1, wherein one of the clamping jaws (36, 38; 360, 380) is configured as manually operated active clamping jaw (36; 360), and the other as passive clamping jaw (38; 380) which is capable of being operated using the active clamping jaw (36; 360) and pivoted with the same.

3. The manual grinding tool as recited in claim 2, wherein the active clamping jaw (36; 360), when closed, rests against the elastically preloaded passive clamping jaw (38; 380) and carries it, against the elastic preload, into the fixable clamping position, via pivoting.

4. The manual grinding tool as recited in claim 3, wherein the active clamping jaw (36; 360) is part of a two-armed clamping lever (35; 350), one of the lever arms of which serves as a handle (39; 390) which is detachably lockable in its clamped position.

5. The manual grinding tool as recited in claim 4, wherein the tongs (34; 340) are pivotable around the swivel axis (40; 400) between two end positions that define their clamped and released positions.

6. The manual grinding tool as recited in claim 5, wherein the surfaces of the active and passive clamping jaws (36, 38) are very rough and/or have a strong grip.

7. The manual grinding tool as recited in claim 1, wherein the passive clamping jaw (380) is a leaf spring and/or a resilient wire.

8. The manual grinding tool as recited in claim 7, wherein the abrasive sheet (150) is clampable with minimal deformation such that it fits between the active (360) and passive clamping jaw (380).

9. The manual grinding tool as recited in claim 8, wherein the active clamping jaw (360) forms an axle stub (410) with which it rests in a recess of the abrasive sheet carrier (14), where it forms the swivel axis (400).

10. The manual grinding tool as recited in claim 9, wherein the active clamping jaw (360) on one side, connected to the axle stub (410) forms the clamping lever (350) and, on the other side, includes means (370, 650, 660, 670) at the end of the other axle stub (410) for vibration damping.

11. The manual grinding tool as recited in claim 10, wherein the means for vibration damping are provided on an extension of the axle stub (410) and bear against the abrasive sheet carrier (14) with preload.

12. The manual grinding tool as recited in claim 10, wherein the abrasive sheet (16; 150) is insertable between the clamping jaws (22; 220; 1220; 500) and the abrasive sheet carrier (14). whereby the clamping jaws (22; 220; 1220; 500) are capable of being opened merely via contact with the abrasive sheet (16; 150), which said abrasive sheet, when moved against the direction of insertion, is automatically lockable as a result of this motion.

13. The manual grinding tool as recited in claim 1, wherein the grinding tool is an oscillating sander.

* * * * *